US006471009B1

(12) United States Patent
Mabry et al.

(10) Patent No.: US 6,471,009 B1
(45) Date of Patent: Oct. 29, 2002

(54) UNIVERSAL SADDLE FOR LIFT

(75) Inventors: Dale Mabry, Lexington; Chris Watson, Madison, both of IN (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 09/742,462

(22) Filed: Dec. 20, 2000

(51) Int. Cl.[7] ..... B66F 7/28
(52) U.S. Cl. ..... 187/218; 187/219; 187/220
(58) Field of Search ..... 187/218, 219, 187/220

(56) References Cited

U.S. PATENT DOCUMENTS

| | | | | |
|---|---|---|---|---|
| 2,045,173 A | | 6/1936 | Baird | |
| 2,458,986 A | | 1/1949 | Frey | |
| 2,612,355 A | | 9/1952 | Thompson | |
| 2,637,522 A | | 5/1953 | Wallace | |
| 2,659,455 A | | 11/1953 | Green | |
| 2,777,538 A | | 1/1957 | Cochin | |
| 2,899,020 A | * | 8/1959 | Halstead | 187/219 |
| 3,052,322 A | * | 9/1962 | Goldzwig | 187/219 |
| 3,057,437 A | | 10/1962 | Sommerer | |
| 3,250,346 A | | 5/1966 | Swick, Jr. | |
| 3,347,342 A | | 10/1967 | Hott | |
| 4,658,933 A | | 4/1987 | Cheek et al. | |
| 5,052,520 A | | 10/1991 | Wakamiya | |

FOREIGN PATENT DOCUMENTS

| | | | | |
|---|---|---|---|---|
| CH | 315693 | * | 10/1956 | 187/219 |
| FR | 1184750 | * | 7/1959 | 187/219 |
| GB | 755405 | * | 8/1956 | 187/219 |
| GB | 1054433 | * | 1/1967 | 187/219 |

* cited by examiner

*Primary Examiner*—Steven A. Bratlie
(74) *Attorney, Agent, or Firm*—Theresa Fritz Camoriano; Guillermo E. Camoriano; Camoriano and Associates

(57) ABSTRACT

A saddle for a vehicle lift provides a flip-up bracket and a body portion that mates with an insert, with the flip-up bracket overlying the body portion when the flip-up bracket is in its extended position.

10 Claims, 5 Drawing Sheets

UNIVERSAL SADDLE FOR LIFT

BACKGROUND OF THE INVENTION

The present invention relates to vehicle lifts, and, in particular, to a saddle arrangement for a lift which provides a wide variety of configurations for the lift with only a few parts.

Various saddle arrangements are known, but most require the shop to purchase a large number of attachments in order for the lift to be able to handle the full range of vehicles. This is expensive, and it can be difficult to keep track of all the attachments.

SUMMARY OF THE INVENTION

The present invention provides a simple saddle arrangement in which only a small number parts is needed to accommodate a wide range of vehicle types.

In a preferred embodiment of the present invention, each saddle defines two receptacles for receiving mounting inserts, and two flip-up mounting plates are mounted on each saddle. When the flip-up mounting plates are flipped up, they are substantially centered over the receptacles, so the flip-up mounting plates have the same range of width adjustment as the receptacles.

DESCRIPTION OF THE PREFERRED EMBODIMENTS

Figure 1:
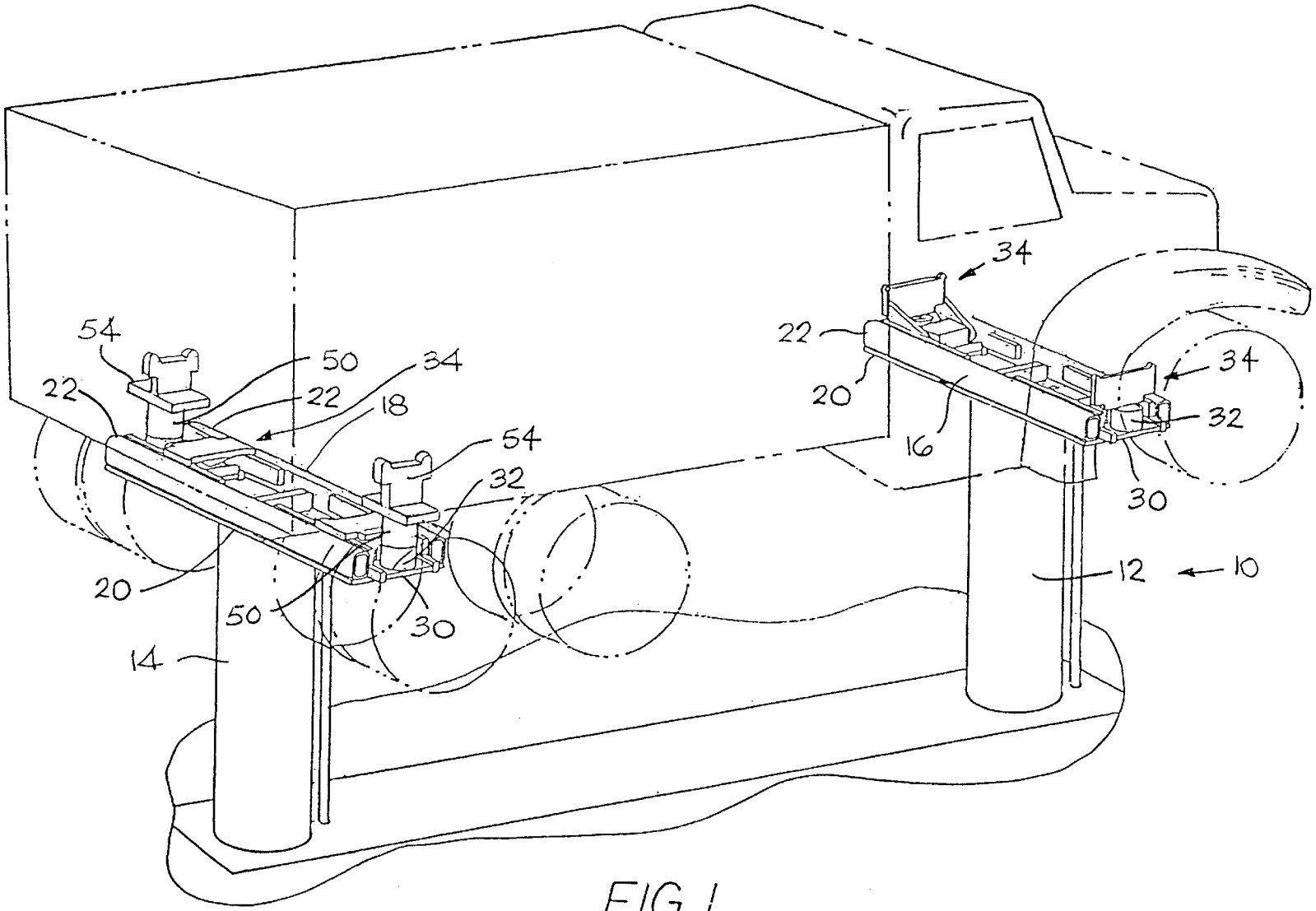
FIG. 1 is a perspective view of a lift made in accordance with the present invention, with a truck shown in phantom.

FIG. 1 is a perspective view of a first example of a lift 10 made in accordance with the present invention. The lift 10 includes front and rear in-ground cylinders 12, 14, as is well known in the art. A front saddle 16 is mounted on top of the front cylinder 12, and a rear saddle 18 is mounted on top of the rear cylinder 14. The front and rear saddles 16, 18 are identical, but they may be configured differently to accommodate different vehicles, as will be described below. FIG. 1 shows a truck in phantom to indicate that the front saddle 16 lifts the front of the truck and the rear saddle 18 lifts the rear of the truck.

FIGS. 2, 3, 3A, and 4 show the saddle 16 in more detail. Again, this saddle 16 is identical to the saddle 18. The saddle 16 includes a platform or saddle base 20, with front and rear structural members 22 welded along the front and rear edges of the platform 20. Track members 24 are welded to the inside of the structural members 22 to form grooves 26 between the track members 24 and the platform 20. Left and right sliding plates 28, 30 slide into those grooves 26 and rest on the platform or saddle base 20.

Each of the sliding plates 28, 30 has two different members mounted on it for supporting a vehicle. First, there is a connector body portion 32, which, in this embodiment, is a cylinder. The flat bottom surface of the cylinder 32 is welded to its respective sliding plate 28, 30, so that the cylinder projects upwardly from its sliding plate. The second member is a flip-up bracket 34, which pivots from a retracted, storage position to an extended, operating position.

The flip-up bracket 34 includes a block of material 36 welded to the sliding plate 28 or 30 just to the inside of the cylinder 32 and a pivot arm 38 mounted to the block 36 by a pin 40. The pivot arm 38 actually includes forward and rear arm portions 42, which lie on the front and rear sides of the block 36. One end of each of the arm portions is pivotably mounted to the block 36 by the pin 40, and the other end of each of the arm portions 42 is connected to a bridging portion 44, which extends between and beyond the forward and rear arm portions 42. The bridging portion 44 has an upper cradle surface 46, which can be used to support a vehicle, and a substantially flat lower contact surface 48, which rests on top of the connector body portion or cylinder 32 when the flip-up bracket 34 is in the operating position as shown in solid lines in FIG. 4.

Figure 2:
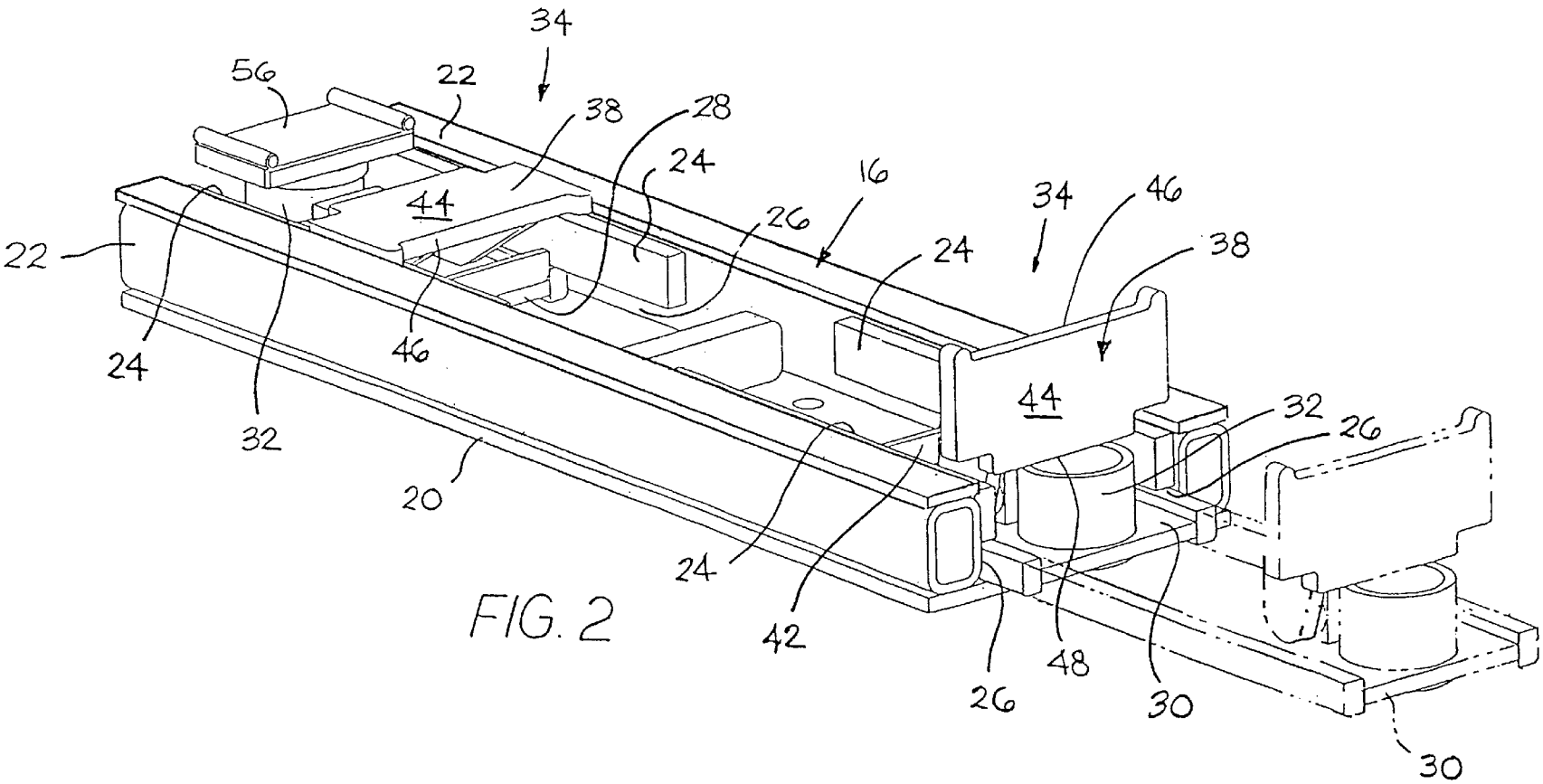
FIG. 2 is a perspective view of one of the saddles of the lift of FIG. 1.

FIG. 2 shows on its left side a flip-up bracket 34 in the retracted, storage position, in which the bridging portion 44 lies substantially parallel to the platform or saddle base 20. On the right of FIG. 2 is a flip-up bracket 34 in the extended, operating position, with the bridging portion 44 of the bracket 34 substantially perpendicular to the platform 20 and resting on the connector body portion 32 and the arm portions 42 straddling the connector body portion 32 (shown best in FIG. 4). The bridging portion 44 preferably rests across the center of the cylinder 32 when in the operating position. In use, it is expected that both of the flip-up brackets 34 on a particular saddle will be in the storage position or both will be in the operating position. However, it is not necessary that the front and rear saddles 16, 18 be configured in the same way, and they frequently may be configured in different ways, as will be described below.

As shown in phantom in FIG. 2, the sliding plates 28, 30 can be manually slid in and out relative to the platform 20 in order to properly align the lift with the vehicle.

Figure 3:
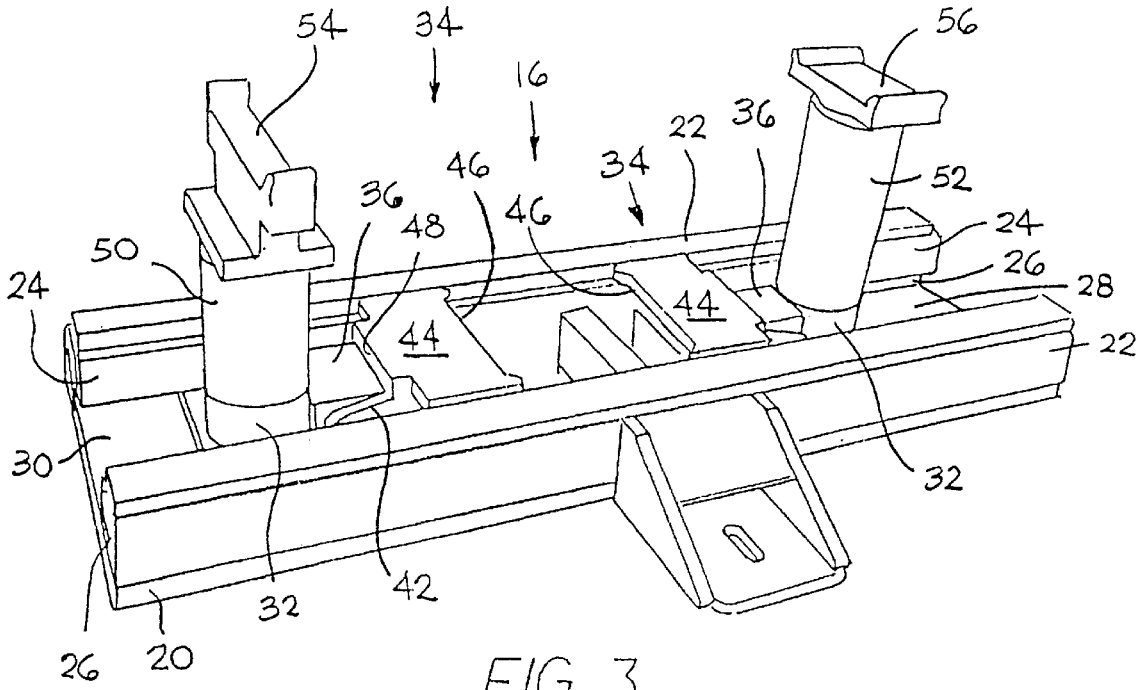
FIG. 3 is a perspective view of the saddle of FIG. 2 with various inserts mounted on the saddle.
Figure 4:
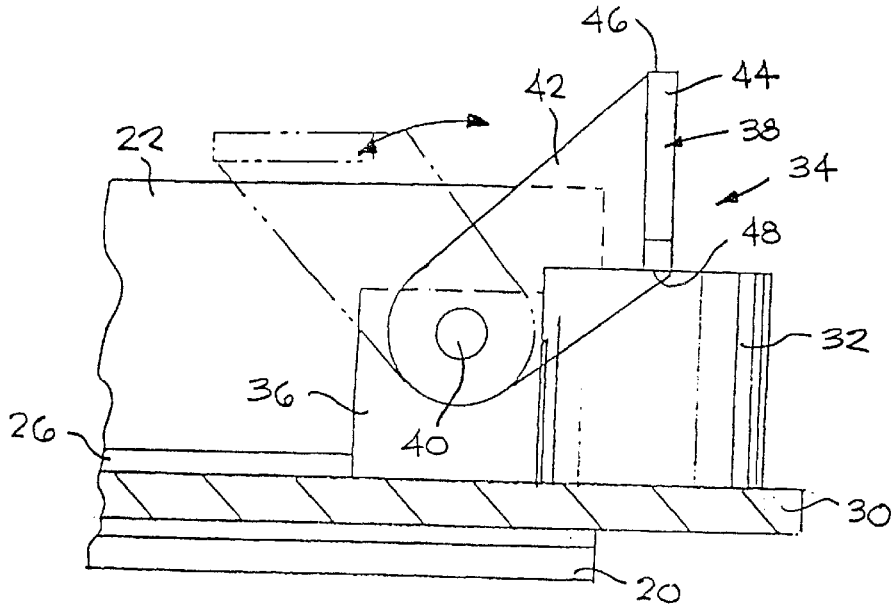
FIG. 4 is a side sectional view of the flip-up portion of the saddle of FIG. 1.
Figure 3A:
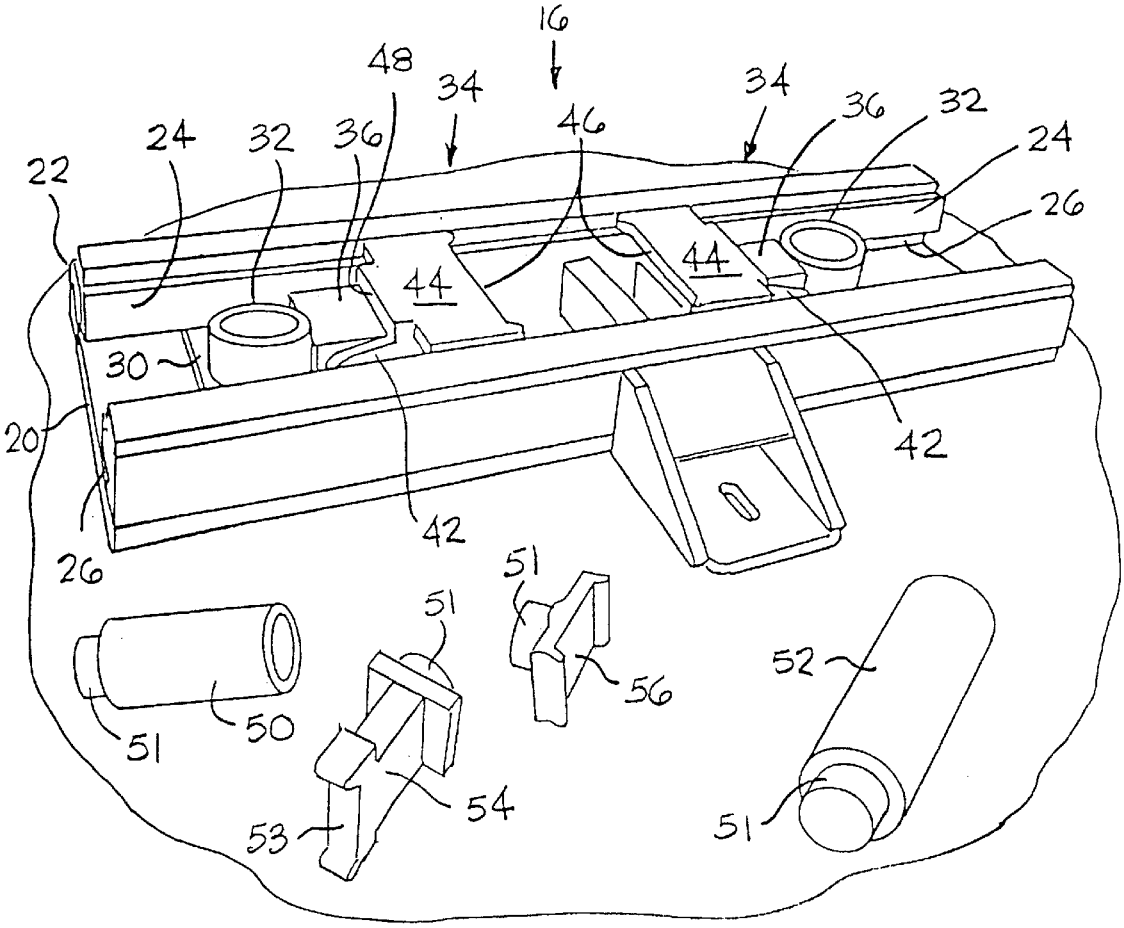
FIG. 3A is a perspective view of the saddle of FIG. 3 with the inserts removed.

The connector body portion 32 can receive various inserts to fit the lift to various vehicle configurations. FIG. 3A shows various inserts that can be used. There is a short extension 50, which is substantially cylindrical in shape and substantially the same diameter as the connector body portion 32, but including a smaller diameter projection 51 at one end. The projection 51 is sized to be received in the interior of the connector body portion 32, with the larger diameter portion of the short extension 50 resting on the top surface of the connector body portion 32. There is also a long extension 52, which also has a smaller diameter projection 51 and which mounts on the connector body portion 32 in the same manner as the short extension 50. There is also a first support bracket 54, which has a connector end and a cradle end 53. The connector end includes a projection 51 that can be received in one of the connector body portions 32 or in the hollow top of one of the extensions 50, 52 in the same manner that the extensions are received in the connector body portions 32. There is also a second support bracket 56, which also has a connector end and a cradle end and which mounts in the same manner as the first support bracket 54.

The left side of FIG. 2 shows the second support bracket 56 mounted directly in the connector body portion 32. The left side of FIG. 3 shows a first support bracket 54 mounted on a short extension 50, that is mounted in the connector body portion 32. The right side of FIG. 3 shows a second support bracket 56 mounted on a long extension 52 mounted in a connector body portion 32. Looking again at FIG. 1, it can be seen that, in normal use, both the left and right sides of the front saddle 16 are configured the same way (in this case with the flip-up brackets 34 in the operating position), and both the left and right sides of the rear saddle 18 are configured the same way (in this case with the first support brackets 54 mounted on short extensions 50 on the connector body portions 32).

With the ability to use various combinations of extensions and support brackets mounted on the connector body portions 32 in conjunction with flip-up brackets 34, a wide range of vehicles can be accommodated on the lift 10 using only a small number of attachments. Also, since each of the flip-up brackets 34 has an operating position that overlies its respective connector body portion 32, the flip-up brackets 34 can be adjusted to the same lateral positions as the other attachments by sliding the sliding plates 28, 30 in and out.

In normal operating conditions, the cylinders 12, 14 are retracted to their lowest position, the attachments and extensions are removed from the saddles 16, 18, and the flip-up brackets are placed in their storage positions. Then, the vehicle is driven over the floor until it is in general alignment with the cylinders 12, 14. One or both of the cylinders may be adjustable in position or the position of the saddle may be adjustable relative to the cylinders so that the two saddles are located directly under their respective axles. Then, the flip-up brackets 34 are flipped up or the appropriate attachments are inserted into their connector body portions 32, and the respective slide plates 28, 30 are slid in and out laterally in order to properly align the lift with the lift points of the vehicle. Then, the cylinders 12, 14 are extended to lift the vehicle up, as shown in FIG. 1. When work on the vehicle is completed, the cylinders 12, 14 are then retracted until the wheels of the vehicle again support the vehicle on the floor. Then the attachments are removed and the flip-up brackets 34 are returned to their storage positions, and the vehicle is driven away.

Figure 3B:
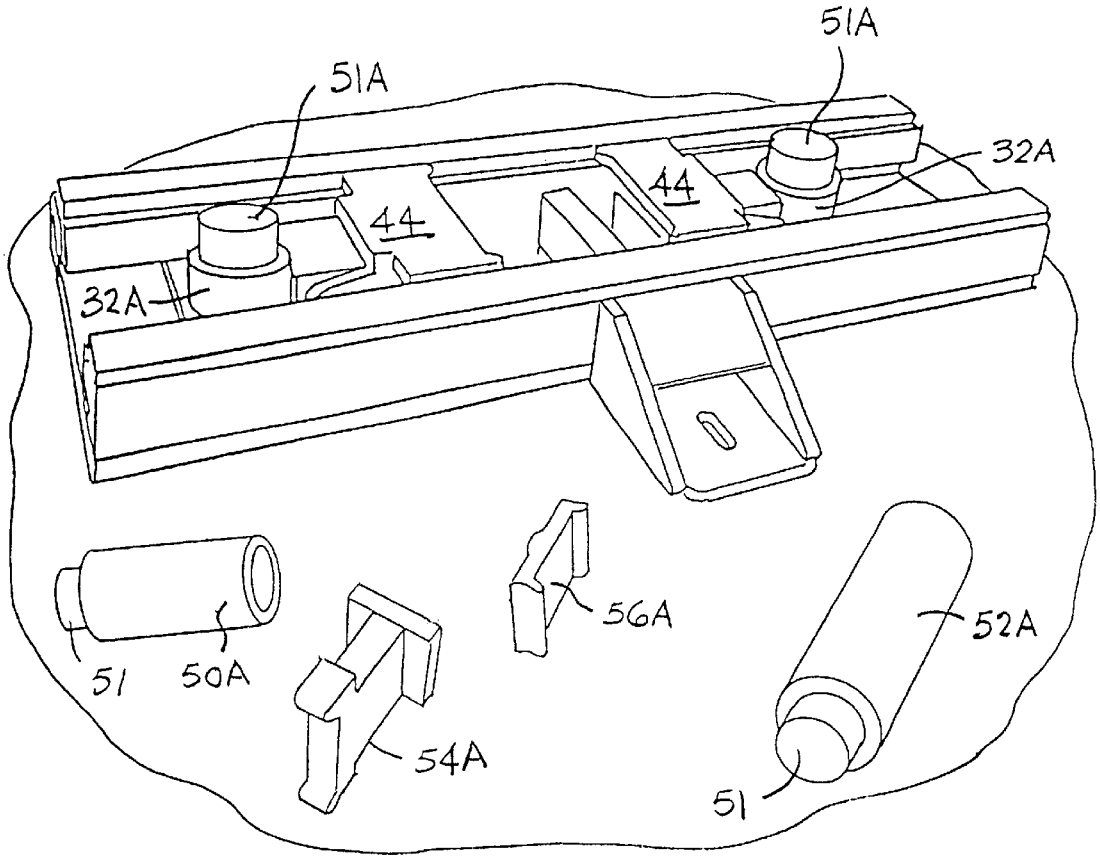
FIG. 3B is the same view as FIG. 3A, but of a slightly different embodiment.

FIG. 3B shows an alternative embodiment that is identical to the first embodiment, except that, instead of the connector body portions 32A being hollow cylinders, these connector body portions include cylindrical projections 51A, which are received in cylindrical receptacles at the connector ends of the attachment members 50A, 52A, 54A, 56A. The extensions 50A, 52A of this embodiment are actually identical to the extensions 50, 52 of the first embodiment, but they are inverted for installation, so that their hollow end mounts over the projections 51A of the connector body portions 32A, and their projections 51 are received in recesses in the support brackets 54, 56.

The saddles described above may also be designed into a rolling bridge assembly.

It will be obvious to those skilled in the art that modifications may be made to the embodiments described above without departing from the scope of the present invention.

What is claimed is:

1. A universal saddle for a vehicle lift, comprising:

a saddle base;

at least one connector body portion mounted on said saddle base; and a flip-up bracket pivotably mounted on said saddle base adjacent to said connector body portion, said flip-up bracket pivotable from a retracted storage position to an extended operating position, wherein, in said operating position, said flip-up bracket overlies said connector body portion.

2. A universal saddle for a vehicle lift as recited in claim 1, and further comprising a first extension having first and second ends, wherein one of said connector body portion and said first end of said first extension defines a receptacle and the other defines a mating projection.

3. A universal saddle for a vehicle lift as recited in claim 2, and further comprising a support bracket, having a connecting end and a cradle end, wherein one of said connecting end of said support bracket and the second end of said first extension defines a projection and the other defines a mating receptacle.

4. A universal saddle for a vehicle lift as recited in claim 3, and further comprising a second extension which has a length different from the length of said first extension.

5. A universal saddle for a vehicle lift as recited in claim 4, in combination with a movable column supporting said saddle.

6. A universal saddle for a vehicle lift as recited in claim 4, wherein said saddle base includes two of said connector body portions, each defining a receptacle; two of said flip-up brackets, and is at least two support bracket inserts, which include projections that mate with the receptacles of the connector body portions.

7. A universal saddle for a vehicle lift as recited in claim 1, wherein said one connector body portion and said flip-up bracket are mounted on a sliding plate which is slidably mounted on said saddle base.

8. A vehicle lift, comprising:

a saddle base;

first and second sliding plates mounted on said saddle base;

a connector body portion and a flip-up bracket mounted on each of said sliding plates, said connector body portion being substantially cylindrical and including one of an upwardly-directed recess and an upwardly-directed projection; wherein said flip-up bracket includes a pair of pivot arm portions and a bridging portion extending between and connected to said pivot arm portions, said bridging portion having an upper cradling surface and a lower surface wherein, when said flip-up bracket is pivoted into its operating position, the lower contact surface of the bridging portion overlies the connector body portion, and further comprising a plurality of mating extensions, each including a first connecting end which mates with the respective connector body portion; and a plurality of support brackets, each of which mates with a respective connector body portion.

9. A vehicle lift as recited in claim 8, wherein the bridging portion of said flip-up bracket rests on said connector body portion when the flip-up bracket is in the operating position.

10. A vehicle lift as recited in claim 8, wherein said lift includes two cylinders, each of said cylinders supporting one of said saddle bases.

* * * * *

UNITED STATES PATENT AND TRADEMARK OFFICE

CERTIFICATE OF CORRECTION

PATENT NO. : 6,471,009 B1
DATED : October 29, 2002
INVENTOR(S) : Dale Mabry et al.

It is certified that error appears in the above-identified patent and that said Letters Patent is hereby corrected as shown below:

Column 4,
Line 26, delete "is".

Signed and Sealed this

Eighteenth Day of February, 2003

JAMES E. ROGAN
*Director of the United States Patent and Trademark Office*